US005513692A

United States Patent [19]

Gerber

[11] Patent Number: 5,513,692

[45] Date of Patent: May 7, 1996

[54] ELECTROMAGNETIC CONFINEMENT OF MOLTEN METAL WITH CONDUCTION CURRENT ASSISTANCE

[75] Inventor: Howard L. Gerber, Chicago, Ill.

[73] Assignee: Inland Steel Company, Chicago, Ill.

[21] Appl. No.: 220,789

[22] Filed: Mar. 31, 1994

[51] Int. Cl.[6] ..... B22D 11/06; B22D 27/02

[52] U.S. Cl. ..... 164/467; 164/428; 164/480; 164/503

[58] Field of Search ..... 164/428, 480, 164/467, 503

[56] References Cited

U.S. PATENT DOCUMENTS

| | | | |
|---|---|---|---|
| 4,020,890 | 5/1977 | Olsson | 164/466 |
| 4,936,374 | 6/1990 | Pareg | 164/503 |
| 4,974,661 | 12/1990 | Lari et al. | 164/503 |
| 5,197,534 | 3/1993 | Gerber et al. | 164/467 |
| 5,197,535 | 3/1993 | Mulcahy | 164/468 |
| 5,251,685 | 10/1993 | Praeg | 164/467 |
| 5,279,350 | 1/1994 | Gerber | 164/467 |

FOREIGN PATENT DOCUMENTS

| | | | |
|---|---|---|---|
| 62-104653 | 5/1987 | Japan | 164/480 |
| WO93/11893 | 6/1993 | WIPO | 164/480 |

OTHER PUBLICATIONS

Kolesnichenko, et al., "Electromagnetic Retention of Steel Melt on the Faces of the Roll Mould" *Proceedings of The Sixth International Iron and Steel Congress,* vol. 4, 1990, Nagoya, ISIJ, pp. 446–453.

U.S. application Ser. No. 08/236,366, filed Apr. 29, 1994, by Kolesnichenko.

*Primary Examiner*—Kuang Y. Lin

*Attorney, Agent, or Firm*—Marshall, O'Toole, Gerstein, Murray & Borun

[57] ABSTRACT

An electromagnetic confining apparatus prevents the escape of molten metal through the open end of a vertically extending gap between two horizontally extending members, such as two counter-rotating rolls of a continuous strip caster. The molten metal is located between the two members. The apparatus includes a vertically disposed coil through which flows a time-varying electric current to generate a first horizontal magnetic field adjacent the open end of the gap. A time-varying conduction current is directed through the pool of molten metal adjacent the open end of the gap, in a vertical direction opposite that of the current flow in the adjacent portion of the coil. The flow of conduction current through the molten metal pool generates a second horizontal magnetic field adjacent the open end of the gap and which augments the first horizontal magnetic field to provide a repulsive body pressure which urges the pool of molten metal inwardly away from the open end of the gap.

22 Claims, 4 Drawing Sheets

ELECTROMAGNETIC CONFINEMENT OF MOLTEN METAL WITH CONDUCTION CURRENT ASSISTANCE

BACKGROUND OF THE INVENTION

The present invention relates generally to apparatuses and methods for electromagnetically confining molten metal and more particularly to an apparatus and method for preventing the escape of molten metal through the open end of a vertically extending gap between two horizontally spaced members between which the molten metal is located.

An example of an environment in which the present invention is intended to operate is a system for continuously casting molten metal directly into strip, e.g. steel strip. Such a system typically comprises a pair of horizontally spaced, counter-rotating rolls defining a horizontally disposed, vertically extending gap therebetween for receiving the molten metal. The gap defined by the rolls tapers in a downward direction toward the nip between the rolls. The rolls are cooled, and in turn cool the molten metal as the molten metal descends through the gap, exiting as a solid metal strip at the nip between the rolls.

The gap has an open end adjacent each end of a roll. The molten metal is unconfined by the rolls at each open end of the gap. To prevent molten metal from escaping outwardly through the open end of the gap, a dam must be employed. Mechanical dams or seals have been used for this purpose, but they have disadvantages which are described in Pareg [sic] U.S. Pat. No. 4,936,374 and in Lari, et al. U.S. Pat. No. 4,974,661, and the disclosures thereof are incorporated herein by reference.

To overcome the disadvantages inherent in the employment of mechanical dams or seals, efforts have been made to confine the molten metal at the open end of the gap by employing an electromagnet having a magnetic core encircled by an electrically conductive coil and having a pair of spaced magnet poles located adjacent the open end of the gap. The magnet is energized by the flow through the coil of a time-varying current (e.g., alternating current or fluctuating direct current), and the magnet generates a time-varying magnetic field extending across the open end of the gap and between the poles of the magnet. The magnetic field can be either horizontal or vertical, depending upon the disposition of the poles of the magnet. Examples of magnets which produce a horizontal field are described in the aforementioned Pareg [sic] U.S. Pat. No. 4,936,374 and in Praeg U.S. Pat. No. 5,251,685. Examples of magnets which produce a vertical magnetic field are described in the aforementioned Lari, et al. U.S. Pat. No. 4,974,661. The disclosures of all of these patents are incorporated herein by reference.

The time-varying magnetic field induces eddy currents in the molten metal adjacent the open end of the gap. The induced eddy currents create their own time-varying magnetic field which, at the open end of the gap, provides a magnetic flux density which is additive to the magnetic flux density provided by the magnetic field from the electromagnet. The resulting repulsive body force is directed toward the molten metal at the open end of the gap. The repulsive body force can be expressed as $f=J\times B$ where f=the repulsive body force at the open end of the gap J=the peak induced current density in the molten metal B=the peak magnetic flux density due to (1) the magnetic field from the electromagnetic and (2) the magnetic field from the induced eddy currents.

Another expedient for magnetically confining molten metal at the open end of a gap between a pair of rolls is to locate, adjacent the open end of the gap, a coil through which a time-varying current flows. This causes the coil to generate a magnetic field which induces eddy currents in the molten metal adjacent the open end of the gap resulting in a repulsive body force similar to that described above in connection with the system employing magnet poles adjacent the gap. Embodiments of a coil-type of magnetic confining dam are described in Gerber, et al. U.S. Pat. No. 5,197,534 and Gerber U.S. Pat. No. 5,279,350, and the disclosures therein are incorporated herein by reference.

Further with respect to the repulsive body force, the integral thereof gives the average repulsive magnetic pressure P which, in the case of the coil-type embodiment of magnetic confining dam, can be expressed as $P=kB^2/4\mu$ where k=the coupling factor between the coil and the molten metal $\mu$=the magnetic permeability of air (and of the molten metal)

B=the peak magnetic flux density (as described above).

The coupling factor is typically less than one. When the molten metal is steel, and the frequency of the time-varying electric current is 3000 Hertz, the coupling factor (k) can have approximate values somewhere between 0.18 and 0.90 depending upon the geometry of the molten metal pool at the open end of the gap. The coupling factor decreases with increased skin depth (i.e. penetration) of the induced eddy currents in the molten metal. Skin depth increases with a reduction in frequency; therefore, a reduction in frequency results in a decrease in the coupling factor (k) which in turn decreases the repulsive body pressure (p).

In order to contain the molten steel, the repulsive body pressure must be at least equal to the pressure urging the molten metal outwardly through the open end of the gap between the rolls. The repulsive body pressure (P) can be increased by increasing the peak magnetic flux density (B) produced by the dam, but an increase in that flux density also increases the power loss in the dam (power dissipated as heat). Average power loss per unit area in the dam (PL) is expressed as follows:

$PL=B^2/(2\mu^2\delta)$ where ($\delta$) is the skin depth in copper, the material of which the confining coil is composed and ($\mu$) is the magnetic permeability of copper.

From the foregoing equation it is apparent that power loss in the dam can be reduced by increasing the skin depth ($\delta$) which can be increased by reducing the frequency of the time-varying current. However as noted above, a reduction in frequency decreases the coupling factor (k) which in turn produces a decrease in the repulsive body pressure (P).

It is desireable to (1) provide a repulsive body pressure sufficiently high to provide containment of the molten metal while (2) reducing the power loss in the dam. In other words, one should provide a relatively high ratio of containment pressure to power loss in the dam. This ratio (P/PL) can be expressed as follows:

$P/PL=\delta k\mu/2$ where ($\delta$) is the skin depth in copper (the material of the coil)

($\mu$) is the magnetic permeability of air (and of copper and the molten steel) and (k) is the coupling factor between the coil and the molten metal.

For purposes of this discussion, the magnetic permeability ($\mu$) of air, copper and the molten steel can be assumed to be the same.

SUMMARY OF THE INVENTION

In accordance with the present invention the power loss in the dam is reduced without any substantial decrease in the repulsive body pressure. This is accomplished by employing a conduction current in the molten metal. Such an arrangement has several advantages (described below) over an arrangement employing solely induced eddy currents in the molten metal for generating a magnetic confining field.

The confining coil, employed in all embodiments of the present invention, has a vertically disposed first confining coil portion facing the pool of molten metal at the open end of the gap between the rolls of the continuous strip caster. The bottom of the first coil portion is electrically connected to the bottom of a vertically disposed second confining coil portion.

An upper electrode extends into the top of the pool of molten metal adjacent the open end of the gap. Other, lower electrodes or brushes (a) contact the solidified steel strip at a location just below the nip of the rolls, adjacent the open end of the gap, or (b) contact the two rolls at that location or (c) contact both the strip and the rolls as in (a) and (b) combined.

In all embodiments, time-varying current is introduced into the first confining coil portion. In one embodiment, all of the current from the current source (e.g. the secondary coil of a transformer) initially flows downwardly through the first coil portion and is then divided into two current flows: (a) one current flow is directed upwardly through the second confining coil portion; (b) another current flow is directed to the lower electrodes or brushes just below the nip of the rolls and then flows upwardly, as conduction current, through the pool of molten metal to the upper electrode.

In another embodiment, the current from the current source is initially provided as two, separate, discrete current flows: (a) one current flow is directed through the first and second confining coil portions as described above; (b) the other current flow is initially directed to the aforementioned lower electrodes or brushes, and it flows, as conduction current, upwardly through the molten metal, as described above.

In all embodiments, there are induced eddy currents in the molten metal pool, as well as conduction current. These eddy currents are induced in the molten metal pool by the magnetic field generated by the confining coil. The magnetic flux density (B) which produces the repulsive body pressure to confine the molten metal pool incorporates three components: (1) the magnetic flux density due to the magnetic field generated by the current flowing through the confining coil; (2) the magnetic flux density due to the magnetic field generated by the induced eddy currents in the pool of molten metal; and (3) the magnetic flux density due to the magnetic field generated by the conduction current flowing through the pool of molten metal. The second component, i.e. (2), is substantially less a factor with regard to the whole of the magnetic flux density than in an arrangement in which the electric currents in the molten metal pool are solely induced eddy currents.

As noted above, when the frequency of the time-varying current is reduced, there is a decrease in the power loss in the coil of the confining dam; but there is also an increase in the skin depth ($\delta$), in the molten metal pool, of the induced eddy currents. This increase in skin depth (depth of penetration of the eddy currents) decreases the coupling factor (k) between the confining coil and the molten metal, which in turn decreases the repulsive body pressure.

However, with regard to the conduction current in the molten metal pool, the depth of penetration of that current (current distribution) is not so much a function of frequency, but rather it is more a function of the placement of the electrodes. (When the time-varying conduction current is fluctuating DC, a reduction in frequency has essentially no effect on current distribution; when the time-varying conduction current is AC, a reduction in frequency has a substantially lessened effect on current distribution than an arrangement without conduction current in the molten metal.) Therefore, a reduction in the frequency of the time-varying conduction current does not produce a significant change in current distribution. Accordingly, there is no significant decrease in the coupling factor (k) (which decreases with increased skin depth).

As a result, a decrease in frequency to reduce the power loss in the confining coil does not produce a decrease in the coupling factor associated with the conduction current; nor does it produce a significant decrease in the flux density due to the magnetic field generated by the conduction current. Any negative effect on the repulsive body pressure from such a reduction in frequency would be substantially less than the negative effect resulting from a situation where the electric currents in the pool of molten metal were solely induced eddy currents.

Decreasing the frequency of the time-varying current decreases not only the power loss in the confining coil, but also it decreases the power loss in the molten metal.

The time-varying current produces a time-varying magnetic field having a corresponding frequency comprising cycles of increasing and decreasing magnetic flux density. The ability of the magnetic field to contain the molten metal can be adversely affected if the frequency of the time-varying current is reduced too much. The frequency cannot be reduced below a lower limit at which the time period between the peak magnetic flux density for consecutive cycles of the time-varying magnetic field is too long to prevent outflow of molten metal through the open end of the gap between the rolls.

For a given input current into the containment system, the magnetic flux density generated by an arrangement in accordance with the present invention, employing conduction current in the pool of molten metal, is greater than the magnetic flux density generated by an arrangement in which the current in the pool of molten metal consists solely of induced eddy currents.

Other features and advantages are inherent in the apparatus and method claimed and disclosed or will become apparent to those skilled in the art from the following detailed description in conjunction with the accompanying diagrammatic drawings.

DETAILED DESCRIPTION

Figure 1:
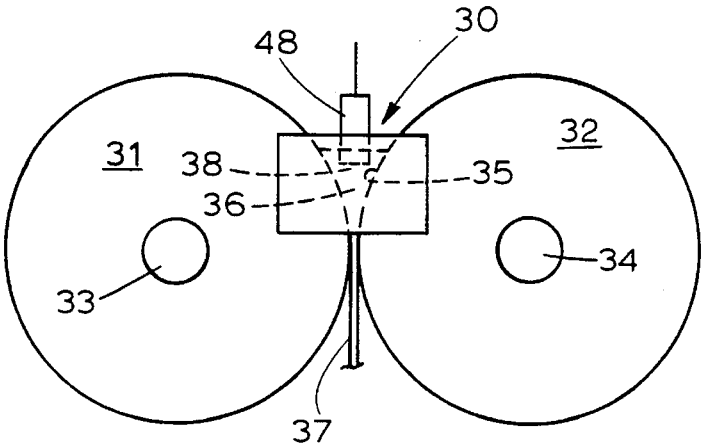
FIG. 1 is an end view of a continuous strip caster employing an embodiment of an electromagnetic confining apparatus in accordance with the present invention.
Figure 2:
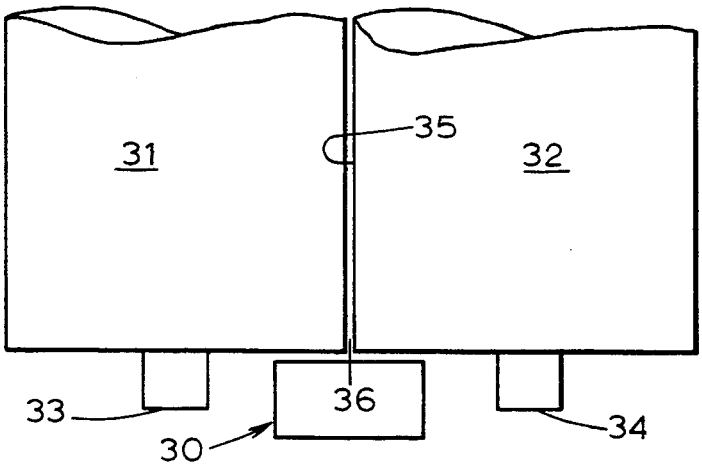
FIG. 2 is a plan view of a portion of the structure illustrated in FIG. 1.
Figure 3:
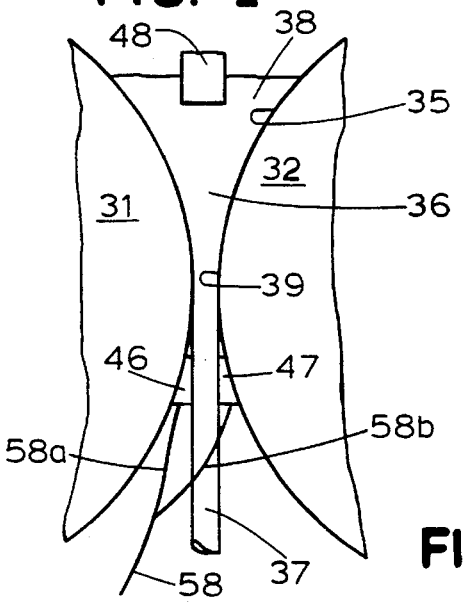
FIG. 3 is an enlarged, fragmentary end view of a portion of the structure shown in FIG. 1.
Figure 4:
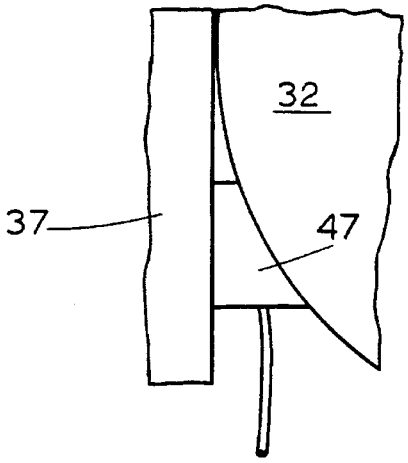
FIG. 4 is an enlarged, fragmentary end view similar to FIG. 3.

Referring initially to FIGS. 1–3, indicated generally at 30 is an electromagnetic confining apparatus for preventing the escape of molten metal 38 through the open end 36 of a vertically extending gap 35 between two horizontally spaced members 31, 32 between which a pool 38 of molten metal is located. The horizontally spaced members comprise a pair of counter-rotating casting rolls of a continuous strip caster. Casting rolls 31, 32 have a nip 39 therebetween at the bottom of vertically extending gap 35. The counter-rotating rolls comprise means for solidifying metal from molten pool 38 into a continuous strip 37 extending downwardly from nip 39. Rolls 31, 32 are cooled in a conventional manner not disclosed here. Pool 38 is typically molten steel.

But for confining apparatus 30, the molten metal in gap 35 would escape through open end 36 of gap 35. Although only one open end 36, and one electromagnetic confining apparatus 30 are shown in the figures, it should be understood that there is an apparatus 30 at each of the two open ends 36 of gap 35.

Referring now to FIGS. 5–7 and 10, electromagnetic confining apparatus 30 comprises an electrically conductive, confining coil 40 adjacent open end 36 of gap 35. Coil 40 generates a first horizontal magnetic field that extends toward molten metal pool 38 through open end 36 of gap 35.

Coil 40 comprises a vertically disposed first confining coil portion 41 facing open end 36 of gap 35 and a vertically disposed second confining coil portion 42 electrically connected at 43 to first coil portion 41. Second coil portion 42 is spaced behind and faces first coil portion 41.

Referring now to FIGS. 3–6 and 10, electromagnetic confining apparatus 30 also comprises brushes 46, 47 for electrically contacting at least one of (a) strip 37 and (b) casting rolls 31, 32, at a location below nip 39 and adjacent open end 36 of gap 35. Apparatus 30 further comprises an electrode 48 for electrically contacting molten metal pool 38 at a location above nip 39 and adjacent open end 36 of gap 35.

Figure 5:
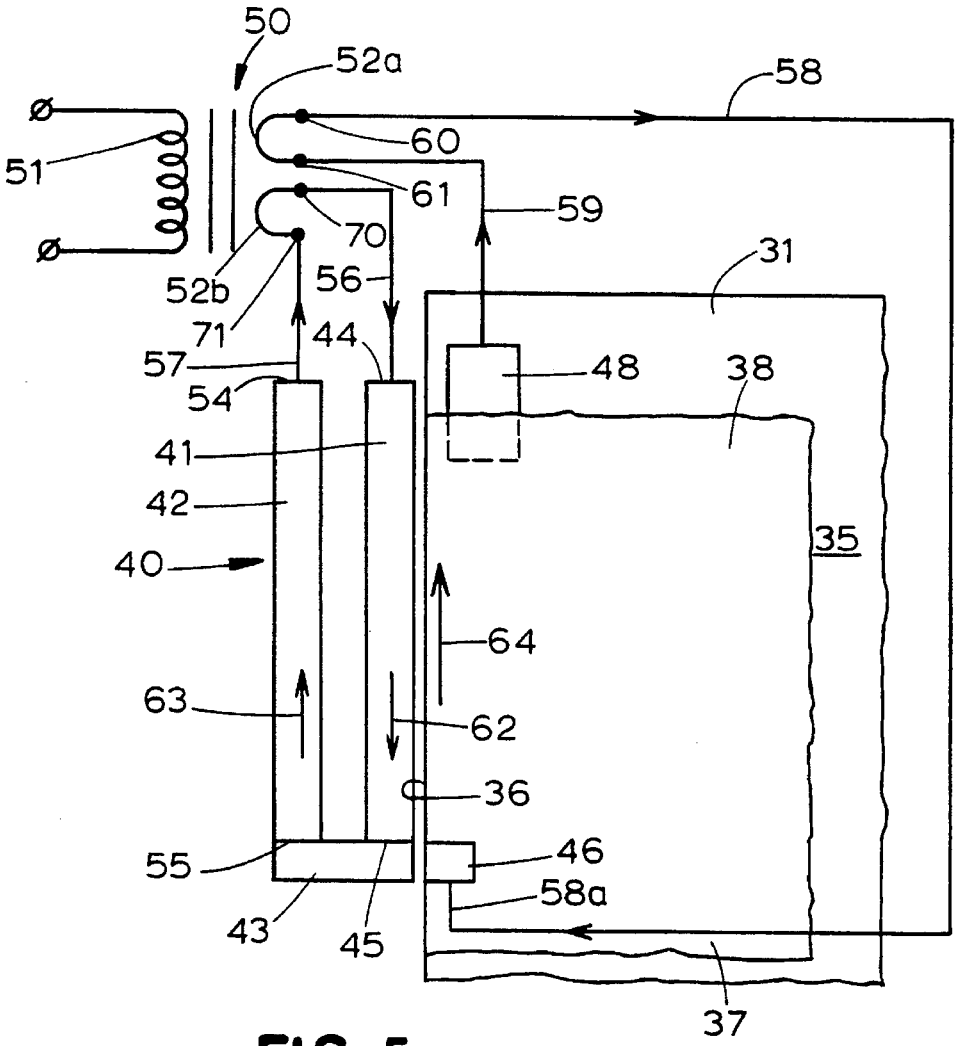
FIG. 5 is a schematic diagram of an embodiment of the confining apparatus employing AC current.
Figure 6:
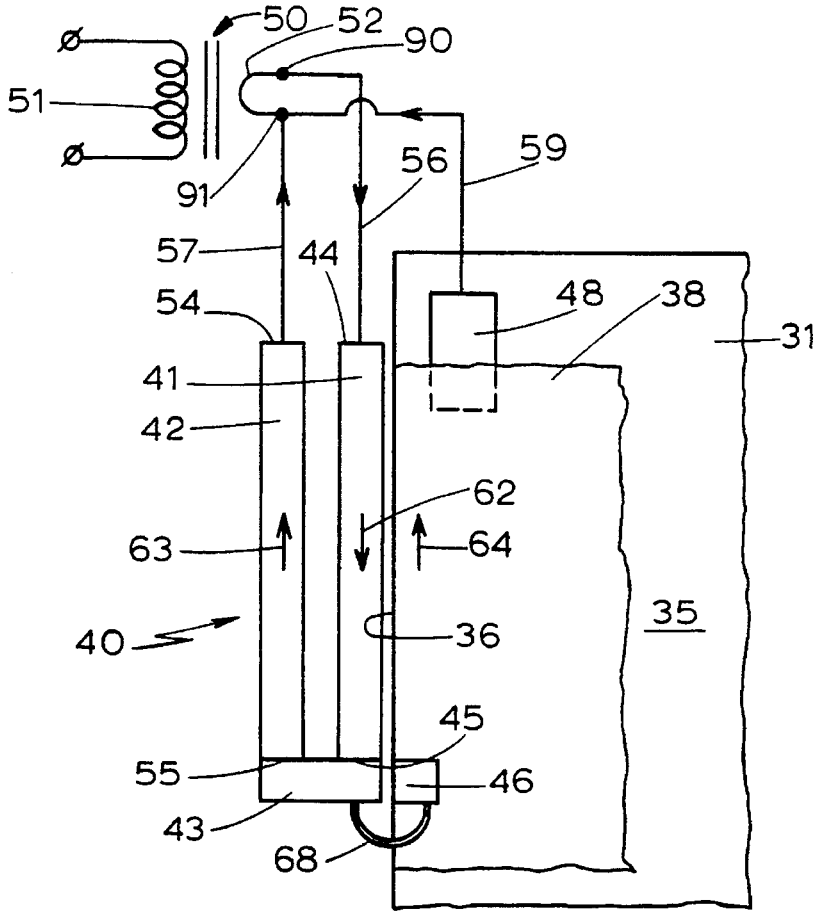
FIG. 6 is a schematic diagram of another embodiment of the confining apparatus employing AC current.
Figure 10:
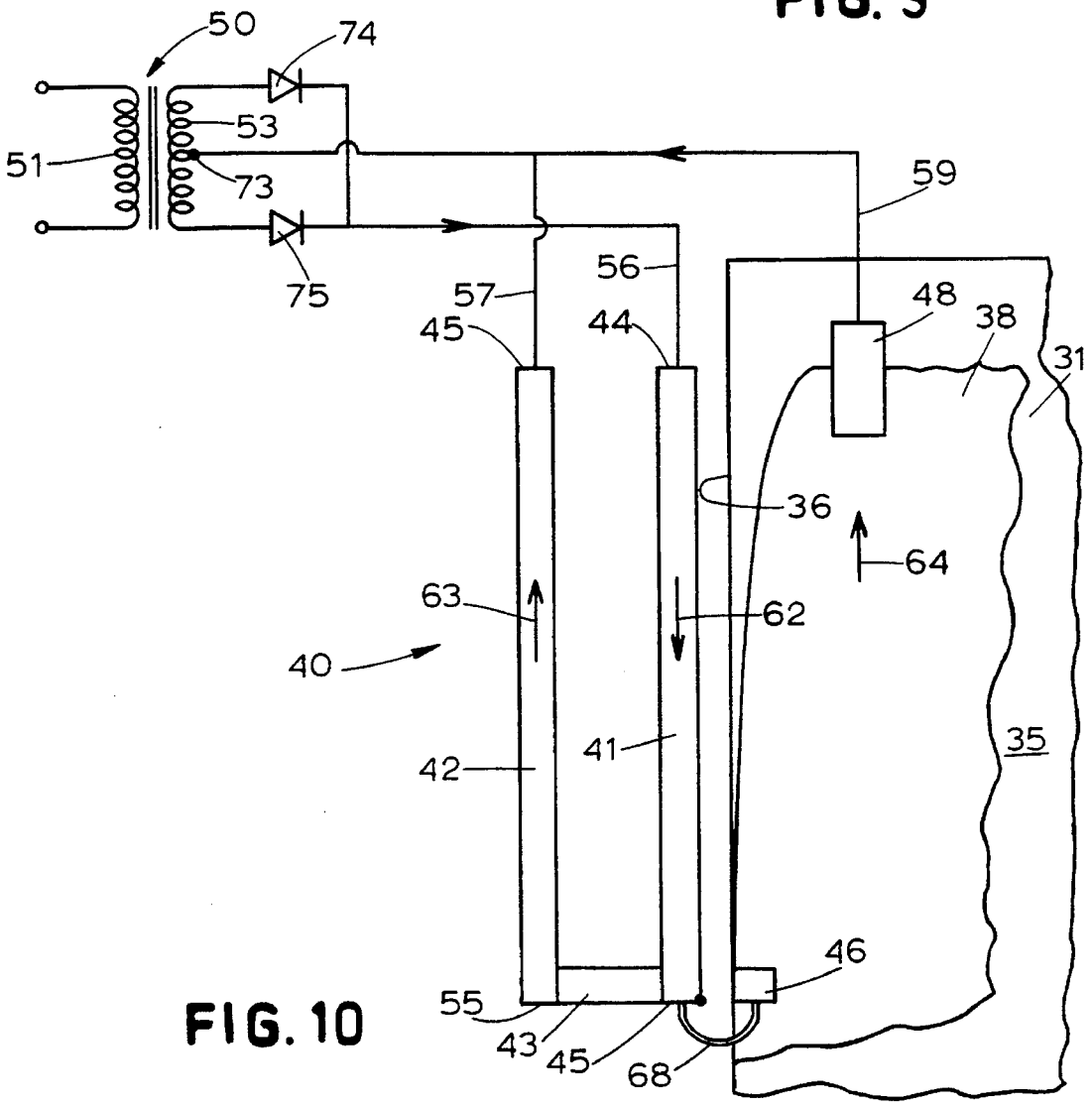
FIG. 10 is a schematic diagram illustrating an embodiment of the confining apparatus employing DC current.

With reference to FIGS. 5, 6 and 10, associated with apparatus 30 is a transformer 50 including a primary coil 51 for receiving an input current and at least one secondary coil, e.g. 52 in FIG. 6. In the embodiment of FIG. 5, the secondary coil comprises a pair of separate, discrete coil portions **52*a* and 52*b*. In the embodiment of FIG. 10, the secondary coil is in the form of a center-tap coil indicated at 53**.

Referring again to the embodiment of FIG. 5, vertically disposed first confining coil portion 41 has upper and lower ends 44, 45 respectively. Vertically disposed second confining coil portion 42 has upper and lower ends 54, 55 respectively. As previously noted, transformer 50 comprises a pair of separate, discrete secondary coil portions **52*a* and 52*b*. Each secondary coil portion includes a pair of opposite coil termini. Line 56 electrically connects one terminus 70 of secondary coil portion 52*b* to upper end 44 of first confining coil portion 41. Return line 57 electrically connects the other terminus 71 of secondary coil portion 52*b* to the upper end 54 of second confining coil portion 42. Line 58 electrically connects one terminus 60 of secondary transformer coil portion 52*a* to brushes 46, 47 via branch lines 58*a*, 58*b* respectively (FIG. 3). Return line 59 electrically connects the other terminus 61 of the transformer's secondary coil portion 52*a* to electrode 48**.

Lines 56 and 57 comprise first conductor means for directing a time-varying electric current from transformer 50 through first coil portion 41, in a first vertical direction (downwardly in FIG. 5), and then through second coil portion 42 in a second vertical direction opposite the first vertical direction, i.e. upwardly through second coil portion 42. More particularly, current from the transformer's secondary coil portion **52*b* flows through line 56, then downwardly through first confining coil portion 41, then through electrical connection 43, connecting the bottoms 45, 55 of coil portions 41 and 42, then upwardly through second confining coil portion 42 and then through return line 57 to secondary coil portion 52*b*. The time-varying current flowing through the confining coil portions 41, 42 generates a first horizontal magnetic field adjacent open end 36 of gap 35**.

Electrically conductive line 58, branch lines **58*a*, 58*b*, brushes 46, 47, electrode 48 and electrically conductive return line 59 comprise second conductor means for directing a time-varying electric current, from the transformer's secondary coil portion 52*a*, vertically through molten metal pool 38, as conduction current, adjacent open end 36 of vertically extending gap 35. The flow of conduction current through pool 38 is in a direction opposite that of the current flowing through first confining coil portion 41 (i.e. upwardly through molten metal pool 38). This flow of conduction current generates a second horizontal magnetic field adjacent open end 36 of gap 35**.

Figure 7:
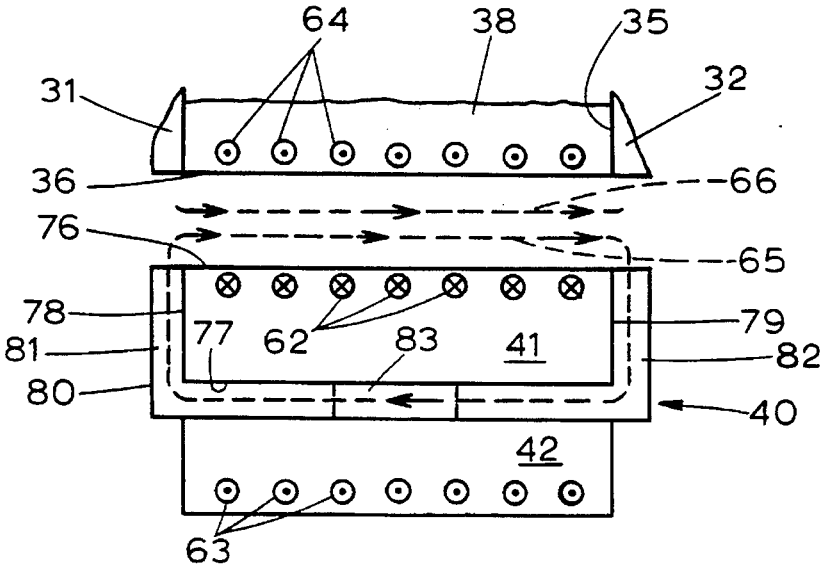
FIG. 7 is a fragmentary plan view of a portion of the confining apparatus illustrating the direction of electric currents and magnetic fields associated with the apparatus.

The directions of the currents flowing through first and second confining coil portions 41, 42 are shown at 62, 63 respectively, and the direction of conduction current flowing through molten metal pool 38 is shown at 64 (FIGS. 5 and 7). The directions of the first and second horizontal magnetic fields are shown at 65 and 66 respectively in FIG. 7. The two magnetic fields flow in the same direction and augment each other.

Confining coil 40, and the first and second conductor means (as described above) comprise apparatus which, in the presence of molten metal pool 38, cooperate to provide a magnetic repulsive pressure which urges the molten metal inwardly away from open end 36 of gap 35.

Referring now to the embodiment of FIG. 6, the secondary coil of the transformer comprises a single coil 52. In this embodiment, line 56 electrically connects one terminus 90 of secondary coil 52 to upper end 44 of first confining coil portion 41. Return line 57 electrically connects the upper end 54 of the second confining coil portion 42 to the other terminus 91 of secondary transformer coil 52. Lower end 45 of first confining coil portion 41 is connected, through electrical connection 43 and a pair of connection lines 68 (only one of which is shown in FIG. 6) to brushes 46, 47. Return line 59 connects electrode 48 to terminus 91 of secondary transformer coil 52. As noted above, terminus 91 is also connected to return line 57 in turn connected to the upper end 54 of second confining coil portion 42.

In the embodiment of FIG. 6, time-varying electric current flows from the transformer's secondary coil 52 through line 56, then downwardly through first confining coil portion 42, then into electrical connection 43 where the current is divided. One part of the current flows upwardly through second confining coil portion 42 and then through line 57 back to the transformer's secondary coil 52. Another part of the current flows through connection lines 68 into brushes 46, 47 and then upwardly through molten metal 38 to electrode 48 from which it flows through return line 59 back to the transformer's secondary coil 52.

In the embodiment of FIG. 6, the directions of current flow through confining coil portions 41, 42 and through molten metal pool 38 are shown at 62, 63 and 64, respectively, in FIGS. 6 and 7, and these directions are the same as the directions of current flow in the embodiment of FIG. 5.

The time-varying current flowing through coil 40 generates a first horizontal magnetic field having a direction shown at 65 in FIG. 7; the time-varying conduction current flowing through molten metal pool 38 generates a second horizontal magnetic field having a direction shown at 66 in FIG. 7. These are the same directions as the magnetic fields generated by the embodiment of FIG. 5. Similarly, the second horizontal magnetic field, having a direction indicated at 66 in FIG. 7, augments the first horizontal magnetic field, having a direction indicated by 65 in FIG. 7, to increase the magnetic repulsive pressure at the open end 36 of gap 35.

In all embodiments of the present invention, the conduction current flowing vertically through molten metal pool 38 always flows in a direction 64 opposite the direction 62 of the current flowing vertically through first confining coil portion 41. As a result of this relationship, the direction 66 of the horizontal magnetic field generated by the conduction current flowing through molten metal pool 38 is always the same as the direction 65 of the horizontal magnetic field generated by coil 40. When the first and second horizontal magnetic fields flow in the same horizontal direction (65, 66 in FIG. 7), they augment each other.

In addition to the conduction current flowing through molten metal pool 38, there can also be, in molten metal pool 38, eddy currents induced by the first horizontal magnetic field and flowing in the same direction 64 as the conduction current. The horizontal magnetic field generated by the induced eddy currents flows in the same direction 66 as the horizontal magnetic field generated by the conduction current flowing through the molten metal pool, and augments the horizontal magnetic field generated by the conduction currents and by the time-varying current flowing through the confining coil 40.

FIGS. 5 and 6 illustrate embodiments in which the time-varying current is AC. The time-varying electric current may also be fluctuating DC. An embodiment employing fluctuating DC is illustrated in FIG. 10. The embodiment of FIG. 10 is similar to the embodiment of FIG. 6, with certain differences. The similarities will not be repeated. The differences are described below.

Transformer 50 in FIG. 10 has a secondary coil 72 with a center tap 73 connected to return lines 57 and 59. Each end of secondary coil 72 is connected to a respective rectifier 74, 75 each in turn electrically connected to line 56 for directing current into the upper end 44 of first confining coil portion 41. Fluctuating DC current from rectifiers 74, 75 flows downwardly through first confining coil portion 41. As the current leaves first confining coil portion 41, at its lower end 45, the current is divided into two parts: a first part of the divided current is directed through electrical connection 43 into second confining coil portion 42 and flows upwardly therethrough; a second part of the divided current is directed through electrical connections 68 and brushes 46, 47 into molten metal pool 38 through which the second part of the current flows upwardly. Return line 57 connects current flowing from the upper end 45 of second confining coil portion 42 to center tap 73 on secondary transformer coil 72, and return line 59 connects current flowing from electrode 48 to center tap 73.

In the embodiments of FIGS. 6 and 10, part of the current flowing downwardly through first confining coil portion 41 also flows through molten metal pool 38. On the other hand, in the embodiment of FIG. 5, no part of the current flowing through molten metal pool 38 flows through any part of confining coil 40.

The horizontal magnetic fields generated by the time-varying current flowing through confining coil 40 and by the conduction current flowing through molten metal pool 38 cooperate to provide a magnetic repulsive pressure which urges molten metal pool 38 inwardly away from open end 36 of gap 35.

Referring again to FIG. 7, first confining coil portion 41 comprises a front face 76, a rear face 77 and a pair of opposite sides 78, 79. Enclosing the first coil portion's side 78, rear face 77 and side 79 is a magnetic member 82 electrically insulated from first coil portion 41, typically by a thin layer of insulation (not shown). Magnetic member 80 is typically composed of conventional magnetic material and defines a low reluctance return path for the magnetic field generated by the time-varying current flowing through confining coil 40. Magnetic member 80 comprises a pair of arm portions 81, 82 each located on a respective opposite side 78, 79 of first coil portion 41 and each extending in the direction of open end 36 of gap 35. Magnetic member 80 also comprises a rear connecting portion 83 extending between arm portions 81, 82 and located between, first and second confining coil portions 41, 42.

The structural configurations which may be employed for coil portions 41, 42 are described in greater detail in the aforementioned Gerber, et al. U.S. Pat. No. 5,197,534, and the disclosure thereof is incorporated herein by reference. However, unlike the apparatus disclosed in the aforementioned Gerber, et al. '534 patent, the apparatus of the present invention is devoid of any magnetic shield on the outside of magnetic arm portions 81, 82. Such a shield has been employed to confine the magnetic field generated by the confining coil to a space adjacent open end 36 of gap 35. This is important where one relies upon induced eddy currents in molten metal pool 38 as the primary current source for the horizontal magnetic field generated by current flowing through molten metal pool 38. In the present invention, however, conduction current is the primary source of current for the horizontal magnetic field generated by current flowing through molten metal pool 38. Accordingly, the magnetic shield of Gerber, et al. '534 is not necessary.

As noted above, electrode 48 is disposed between casting rolls 31, 32, above nip 39 (FIG. 2). Electrode 48 is composed of an electrically conductive material which is resistant to the high temperature of molten metal pool 38 into which electrode 48 is at least partially immersed. Electrode 48 may be composed of graphite, for example.

Casting rolls 31, 32 may be composed of copper, or copper alloy, or a ceramic material or austenitic (non-magnetic) stainless steel.

Figure 9:
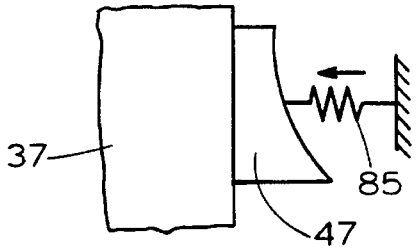
FIG. 9 is an enlarged, fragmentary end view representationally illustrating another portion of the apparatus.

A casting roll composed of ceramic material is not very conductive electrically. In such a case, the relevant electrical connection to molten metal pool 38 is through brushes 46, 47 and strip 37. Preferably, a spring is employed to urge the brush into contact with strip 37, and such a spring is shown representationally at 85 in FIG. 9.

Figure 8:
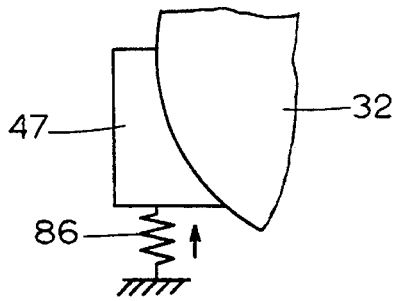
FIG. 8 is an enlarged, fragmentary end view representationally illustrating a portion of the apparatus.

When the casting rolls are composed of a electrically conductive material, such as copper or copper alloy, the relevant electrical connection to molten metal pool 38 includes the casting rolls. In other words, the relevant electrical connection is between a brush 46, 47 and a roll 31, 32; the connection may additionally be between a brush and strip 37. When the relevant electrical connection is between a brush and a casting roll, preferably a spring 86 is employed to urge the brush into contact with the casting roll, and such a spring is shown representationally at 86 in FIG. 8.

Brushes 46, 47 are composed of an electrically conductive material, such as graphite or phosphor bronze.

When a brush is composed of metal (such as phosphor bronze), it may be internally cooled. When the brush is composed of graphite, cooling may be effected by employing a brush holder which is internally cooled. Cooling arrangements of the types described in the preceding parts of this paragraph are within the skill of the art.

The foregoing detailed description has been given for clearness of understanding only and no unnecessary limitations should be understood therefrom, as modifications will be obvious to those skilled in the art.

I claim:

1. An electromagnetic confining apparatus for preventing the escape of molten metal through the open end of a vertically extending gap between two horizontally spaced members between which a pool of said molten metal is located, said apparatus comprising:

electrically conductive, confining coil means, adjacent the open end of said gap, for generating a first horizontal magnetic field that extends toward said pool of molten metal through the open end of the gap;

said confining coil means comprising a vertically disposed first confining coil portion facing said open end of the gap and a vertically disposed second confining coil portion electrically connected to said first coil portion and spaced behind and facing said first coil portion;

first conductor means for directing a time-varying electric current through one of said coil portions, in a first vertical direction, and then through the other of said coil portions in a second vertical direction opposite said first vertical direction, to generate said first horizontal magnetic field adjacent the open end of said gap;

second conductor means for directing said time-varying electric current vertically through said molten pool, as conduction current, adjacent the open end of said vertically extending gap, in a direction opposite that of the current flowing through said first coil portion, to generate a second horizontal magnetic field adjacent the open end of said gap;

means, including said confining coil means and said first and second conductor means, cooperating, in the presence of said molten pool, to provide a magnetic repulsive pressure which urges said molten metal inwardly away from said open end of the gap.

2. An apparatus as recited in claim 1 wherein:

said horizontally spaced members comprise a pair of counter-rotating casting rolls of a continuous strip casting apparatus;

said casting rolls having a nip therebetween at the bottom of said vertically extending gap;

and said counter-rotating rolls comprise means for solidifying metal from said molten pool into a continuous strip extending downwardly from said nip.

3. An apparatus as recited in claim 2 and comprising:

transformer means including primary coil means for receiving an input current and at least one secondary coil means for connection to said first and second conductor means.

4. An apparatus as recited in claim 3 wherein said second conductor means comprises:

brush means for electrically contacting at least one of (a) said strip and (b) a casting roll, at a location below said nip and adjacent the open end of said gap;

and electrode means for electrically contacting said molten pool at a location above said nip and adjacent the open end of said gap.

5. An apparatus as recited in claim 4 wherein:

said vertically disposed first confining coil portion has upper and lower ends;

said secondary coil means of the transformer comprises a single coil;

said first conductor means comprises means for directing current from said single secondary coil of the transformer into the upper end of said first confining coil portion;

and said second conductor means comprises means for electrically connecting the lower end of said first confining coil portion to said brush means.

6. An apparatus as recited in claim 4 wherein:

each of said vertically disposed first and second confining coil portions has upper and lower ends;

said secondary coil means of the transformer comprises a pair of separate, discrete secondary coils;

each of said secondary coils of the transformer includes a pair of termini;

said first conductor means comprises (a) first means for electrically connecting one terminus of one secondary transformer coil to the upper end of one vertically disposed confining coil portion and (b) second means for electrically connecting the other terminus of said one secondary transformer coil to the upper end of the other vertically disposed confining coil portion;

said second conductor means comprises one line for electrically connecting one terminus of the other secondary transformer coil to one of (i) said brush means and (ii) said electrode means;

and said second conductor means further comprises another line for electrically connecting the other terminus of said other secondary transformer coil to the other of (i) said brush means and (ii) said electrode means.

7. An apparatus as recited in claim 6 wherein:

said first electrical connecting means of the first conductor means comprises means for electrically connecting said one terminus of said one secondary transformer coil to the upper end of said first vertically disposed confining coil portion;

and said one line of said second conductor means comprises means for electrically connecting said one terminus of said other secondary transformer coil to said brush means.

8. An apparatus as recited in claim 4 wherein:

said electrode means is disposed between-said casting rolls, above said nip, and comprises means for at least partial immersion into said pool of molten metal.

9. An apparatus as recited in claim 8 wherein said electrode is composed of graphite.

10. An apparatus as recited in claim 4 wherein:

each of said casting rolls is composed of at least one of (a) copper and (b) copper alloy;

and said apparatus comprise means for urging said brush means into contact with said roll.

11. An apparatus as recited in claim 4 wherein: each of said casting rolls is composed of a ceramic material;

and said apparatus comprises means for urging said brush means into contact with said strip.

12. An apparatus as recited in claim 10 or 11 wherein: said brush means is composed of one of (a) graphite and (b) phosphor bronze.

13. An apparatus as recited in claim 4 wherein: each of said casting rolls is composed of austenitic stainless steel.

14. An apparatus as recited in claim 1 and comprising:

a pair of opposite sides on said vertically disposed first confining coil portion;

means, composed of magnetic material, for defining a low reluctance return path for said first magnetic field;

said means composed of magnetic material comprising (a) a pair of arm portions each located on a respective opposite side of said first confining coil portion and extending in the direction of the open end of said gap and (b) a connecting portion extending between said arm portions and located between said vertically disposed first and second confining coil portions;

said apparatus being devoid of any magnetic shield on the outside of said arm portions.

15. An apparatus as recited in claim 1 wherein:

said means that generates said second horizontal magnetic field comprises means for augmenting said first horizontal magnetic field to increase the magnetic repulsive pressure at the open end of said gap.

16. An apparatus as recited in claim 1 wherein said time-varying electric current is alternating current.

17. An electromagnetic confining method for preventing the escape of molten metal through the open end of a vertically extending gap between two horizontally spaced members between which said molten metal is located, said method comprising the steps of:

providing electrically conductive confining coil means comprising a first vertically disposed confining coil portion facing said open end of the gap and a vertically disposed second confining coil portion electrically connected to said first confining coil portion and spaced behind and facing said first confining coil portion;

directing a time-varying electric current through one of said confining coil portions in a first vertical direction, and then through the other of said confining coil portions in a vertical direction opposite said first vertical direction, to generate a first horizontal magnetic field that extends toward said pool of molten metal through the open end of said gap;

and directing said time-varying electric current vertically through said molten pool, as conduction current, adjacent the open end of said gap, in a direction opposite that of the current flowing through said first coil portion, to generate a second horizontal magnetic field adjacent the open end of said gap;

said previously recited steps cooperating to provide a magnetic repulsive pressure which urges said molten metal inwardly away from said open end of the gap.

18. A method as recited in claim 14 wherein:

said second horizontal magnetic field augments said first horizontal magnetic field to increase the magnetic pressure at the open end of said gap.

19. A method as recited in claim 17 and comprising:

providing a low reluctance return path, composed of magnetic material, for said first magnetic field and without employing a magnetic shield for said return path.

20. A method as recited in claim 18 and comprising:

directing said current downwardly through said first confining coil portion;

dividing said current into two parts as the current leaves said first confining coil portion;

directing a first part of said divided current upwardly through said second confining coil portion; and directing a second part of said divided current upwardly through said pool of molten metal as said conduction current.

21. A method as recited in claim 17 and comprising:

directing a first current flow downwardly through said first confining coil portion;

providing a second current flow which does not flow through said confining coil means;

and directing said second-current flow upwardly through said pool of molten metal as said conduction current.

22. A method as recited in claim 17 wherein said time-varying electric current is alternating current.

* * * * *